US005136947A

United States Patent [19]

Philpot

[11] Patent Number: 5,136,947

[45] **Date of Patent: * Aug. 11, 1992**

[54] SPECIALLY CONFIGURED PRINTING PLATE SECUREMENT APPARATUS

[75] Inventor: Ivan N. Philpot, Irving, Tex.

[73] Assignee: Matthews International Incorporated, Pittsburgh, Pa.

[ * ] Notice: The portion of the term of this patent subsequent to Feb. 11, 2009 has been disclaimed.

[21] Appl. No.: 675,751

[22] Filed: Mar. 27, 1991

[51] Int. Cl.[5] ..... B41F 27/00

[52] U.S. Cl. ..... 101/415.1; 101/378; 101/383

[58] Field of Search ..... 101/377, 378, 382.1, 101/383, 415.1, 385

[56] References Cited

U.S. PATENT DOCUMENTS

| | | | |
|---|---|---|---|
| 3,213,790 | 10/1965 | McKay | 101/376 |
| 3,228,329 | 1/1966 | Mangus et al. | 101/378 |
| 3,295,443 | 1/1967 | Devon | 101/376 |
| 3,489,085 | 1/1970 | Kirkpatrick | 101/415.1 |
| 3,675,573 | 7/1972 | Hawks | 101/378 |
| 3,745,921 | 7/1973 | MacDonald et al. | 101/378 |
| 3,934,509 | 1/1976 | Saunders et al. | 101/415.1 |
| 4,932,324 | 6/1990 | Pinkston et al. | 101/415.1 |

OTHER PUBLICATIONS

"It's Time for a Change in Flexo", Box Board Containers, Dec., 1979.

*Primary Examiner*—Edgar S. Burr
*Assistant Examiner*—Ren Yan
*Attorney, Agent, or Firm*—James Ray & Associates

[57] ABSTRACT

This invention provides a securement apparatus for a printing plate. The apparatus includes a first flat strip-like portion, a second flat strip-like portion narrower than the first flap strip-like portion and a third flat strip-like portion which is also narrower than the first flat strip-like portion. A first connecting strip-like portion connects the first flat strip-like portion to the second flat strip-like portion and a second connecting strip-like portion connects the first flat strip-like portion to the third flat strip-like portion thereby forming an S-shaped printing plate securement apparatus.

20 Claims, 1 Drawing Sheet

SPECIALLY CONFIGURED PRINTING PLATE SECUREMENT APPARATUS

FIELD OF THE INVENTION

The present invention relates, in general, to equipment used for securing a printing plate to at least a portion of a working surface of at least one printing plate cylinder disposed in at least one print station of a printing arrangement and, more particularly, this invention relates to a specially configured printing plate securement apparatus which enables both securing a printing plate to such working surface of such at least one printing plate cylinder and in achieving a quick alignment of such printing plate in a predetermined position on such working surface of such printing plate cylinder.

CROSS-REFERENCE TO RELATED APPLICATIONS

The invention taught and claimed in this application is closely related to U.S. patent application Ser. No. 07/586,272 entitled, "An Apparatus for Securing a Printing Plate to a Printing Plate Cylinder and a Printing Plate Composite Utilizing Such Apparatus", filed on Sep. 21, 1990 and to U.S. patent application Ser. No. 07/586,273 entitled, "An Improved Printing Plate Composite Including a Quick Mounting System for Securing Such Composite to a Printing Plate Cylinder", filed on Sep. 21, 1990 and to U.S Ser. No. 07/662,727 entitled, "A Printing Plate Mounting System and a Printing Plate Composite Utilizing Such System", filed on Feb. 28, 1991 and is related to U.S. patent application Ser. No. 07/675,743 filed concurrently herewith and to U.S. patent application Ser. No. 07/675,744 also filed concurrently herewith. The disclosure of such closely related U.S. Patent Applications being incorporated herein by reference thereto.

BACKGROUND OF THE INVENTION

During the recent past, it has become the generally accepted practice, in the retail sales industry, to utilize what is known in the packaging manufacturing industry as "point of sales" packaging for the majority of products to be offered for sale in a retail outlet. The particular practice, as would be more or less expected, has forced the package manufacturing industry to both develop and implement new equipment and operating procedures. Such new equipment and operating procedures being necessary to achieve significant improvement in the quality of printing. In other words, the former "brown box" would no longer be an acceptable package for products offered for sale in a retail outlet.

As a result, flexographic printing was introduced into such package printing industry. Flexographic printing is now in widespread use. See, for example, an article published in the December, 1979 issue of Box Board Containers titled "It's Time for a Change in Flexo". As pointed out in this particular article, flexographic printing entered the package printing industry in the 1960's. It was at this time that packaging converters began installing the necessary equipment to initiate use of the flexographic printing process. Such packaging converters could now print, slot, fold, glue, die-cut and bundle in a true production line manner with this new flexographic equipment.

This change in equipment for flexography offered the potential for extended capabilities and other improvements in package printing; in addition to all the advantages of the in-line operations discussed above. This was not the case, however, because these additional benefits were not immediately taken advantage of by the packaging converters. For example, even with this new equipment and process, the packaging converters continued to use the same printing plate systems they had been using prior to the introduction of the flexo printing system. Such printing plate system consists of a relatively thick rubber plate secured to a fabric-like material which, in turn, was secured to a carrier material.

It is also known, in the prior art, to use a substantially T-shaped member in order to align and secure one end of a printing plate carried, on a sheet material, to the printing plate cylinder. Such securement occurring substantially parallel to the longitudinal axis of the printing plate cylinder. In this case, the printing plate is disposed on a vinyl-like sheet member which, in turn, is engageable with the working surface of such printing plate cylinder. The T-shaped member is secured to one end of the vinyl-like sheet member and the axially opposed other end of such vinyl-like sheet member is secured to the printing plate cylinder with tape or strap-like members. This particular fastening system for the printing plate is commonly known in the package printing industry as the Matthews Fast-Loc. This system, which is in widespread use in the packaging industry, results in lower down time to the printing arrangement being required in order to achieve proper alignment of the printing plate on the working surface of the printing plate cylinder.

SUMMARY OF THE INVENTION

The present invention provides a specially configured printing plate securement apparatus. This securement apparatus is used to both secure at least one printing plate to at least a portion of a working surface of at least one printing plate cylinder disposed in at least one print station of a printing arrangement and to achieve a relatively quick alignment of such printing plate in a predetermined position on such working surface of the printing plate cylinder. This specially configured printing plate securement apparatus includes a first elongated and substantially flat strip-like portion having each of axially opposed outer edges and axially opposed surfaces. Such first flat strip-like portion further has a first predetermined length, a first predetermined width and a first predetermined thickness. The apparatus also includes a second elongated and substantially flat strip-like portion having each of axially opposed outer edges and axially opposed surfaces. Such second flat strip-like portion further having a second predetermined length, a second predetermined width, which is less than such first predetermined width of the first flat strip-like portion, and a second predetermined thickness. A first of such axially opposed surfaces of such second flat strip-like portion is positioned facing a first of such axially opposed surfaces of the first flat strip-like portion. Further, such securement apparatus includes a third elongated and substantially flat strip-like portion having each of axially opposed outer edges and axially opposed surfaces. Such third flat strip-like portion further having a third predetermined length and a third predetermined width, which is also a less than such first predetermined width of such first flat strip-like portion and a third predetermined thickness. A first of such axially opposed surfaces of the third flat strip-like portion is positioned facing a second of such axially opposed surfaces of the first flat strip-like portion. In addition, the apparatus includes a first elongated connecting strip-like portion having axially opposed outer edges and axially opposed surfaces. This first connecting strip-like portion further having a fourth predetermined length and a fourth predetermined width and a fourth predetermined thickness. A first outer edge of such first connecting strip-like portion is connected to a first outer edge of such first strip-like portion substantially along the first predetermined length of such first strip-like portion and such fourth predetermined length of such fourth connecting strip-like portion. A second outer edge of such first connecting strip-like portion is connected to a first outer edge of the second elongated flat strip-like portion. A second of such axially opposed outer edges of the second flat strip-like portion being engageable in a groove-like portion formed adjacent a working surface of such printing plate cylinder. This groove-like portion being disposed substantially parallel to a longitudinal axis of the printing plate cylinder. The final essential element of the printing plate securement apparatus is a second elongated connecting strip-like portion which has axially opposed outer edges and axially opposed surfaces. This second connecting strip-like portion further has a fifth predetermined length and a fifth predetermined width, which is equal to or less than the such fourth predetermined width of the first connecting strip-like portion, and a fifth predetermined thickness. A first outer edge of such second connecting strip-like portion is connected to a second outer edge of such first flat strip-like portion along such first predetermined length of such first flat strip-like portion and the fifth predetermined length of such second connecting strip-like portion. A second outer edge of such axially opposed outer edges of such second connecting strip-like portion being connected along said fifth predetermined length thereof to a first outer edge of such third flat strip-like portion along said third predetermined length thereof, thereby forming a specially configured S-shaped printing plate securement apparatus.

BRIEF DESCRIPTION OF THE VARIOUS EMBODIMENTS OF THE PRESENT INVENTION

Figure 1:
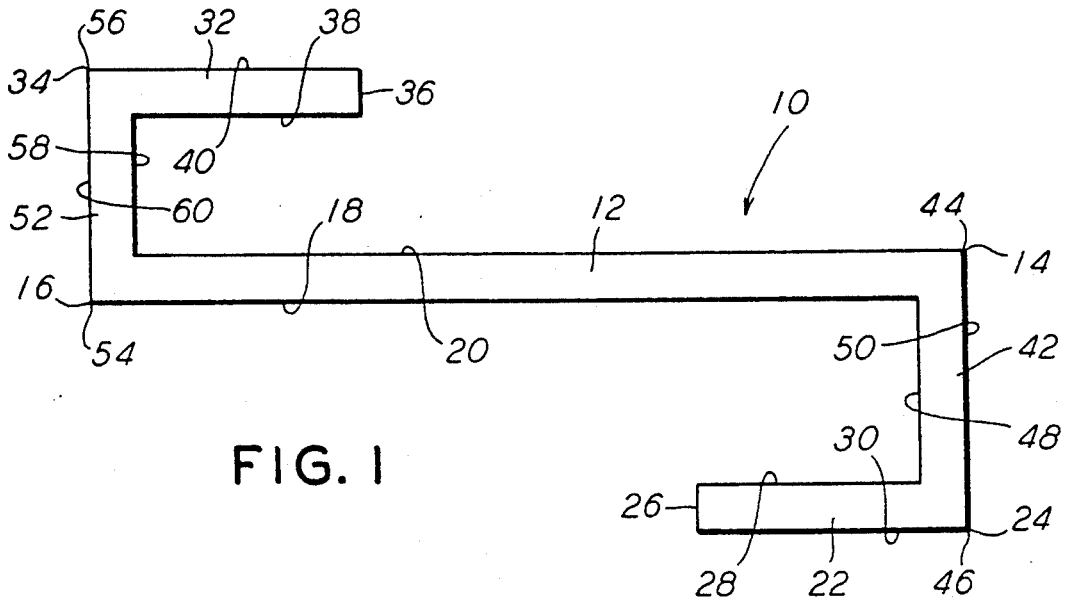
FIG. 1 is a side elevation view of a presently preferred embodiment of the specially configured printing plate securement apparatus constructed according to the present invention.

Prior to proceeding to the more detailed description of the specially configured printing plate securement apparatus, it should be noted that, for the sake of clarity, in each of the drawing figures, identical components having identical functions have been identified with identical reference numerals.

Now refer, more particularly, to FIG. 1. Illustrated therein is a specially configured printing plate securement apparatus, generally designated 10. Such apparatus 10 is useful both in securing at least one printing plate (not shown) to at least a portion of a working surface (not shown) of at least one printing plate cylinder (not shown) disposed in at least one print station (not shown) of a printing arrangement (not shown) and in achieving a relatively quick alignment of such printing plate in a predetermined position on the working surface of such printing plate cylinder.

This specially configured printing plate securement apparatus 10 comprises a first elongated and substantially flat strip-like portion 12 having each of axially opposed outer edges 14 and 16 and axially opposed surfaces 18 and 20. Such first flat strip-like portion 12 further having a first predetermined length and a first predetermined width and a first predetermined thickness.

There is a second elongated and substantially flat strip-like portion 22 which has each of axially opposed outer edges 24 and 26 as well as axially opposed surfaces 28 and 30. Such second flat strip-like portion 22 further having a second predetermined length and a second predetermined width, which is less than such first predetermined width of the first flat strip-like portion 12, and a second predetermined thickness. A first surface 28 of such axially opposed surfaces 28 and 30 of such second flat strip-like portion 12 is positioned facing a first surface 18 of such axially opposed surfaces 18 and 20 of the first flat strip-like portion 12.

Apparatus 10 further includes a third elongated and substantially flat strip-like portion 32 having each of axially opposed outer edges 34 and 36 and axially opposed surfaces 38 and 40. Such third flat strip-like portion 32 further having a third predetermined length and a third predetermined width, which is also less than the such first predetermined width of the first flat strip-like portion 12, and a third predetermined thickness. A first surface 38 of such axially opposed surfaces 38 and 40 of the third flat strip-like portion 32 is positioned such that it faces a second surface 20 of such axially opposed surfaces 18 and 20 of the first flat strip-like portion 12.

Another essential element of the printing plate securement apparatus 10 is a first elongated connecting strip-like portion 42 having axially opposed outer edges 44 and 46 and axially opposed surfaces 48 and 50. Such first connecting strip-like portion 42 further having a fourth predetermined length and a fourth predetermined width and a fourth predetermined thickness. A first outer edge 44 of such first connecting strip-like portion 42 being connected to a first outer edge 14 of such first flat strip-like portion 12 along the first predetermined length of such first flat strip-like portion 12 and such fourth predetermined length of such first connecting strip-like portion 42. The second outer edge 46 of such axially opposed outer edges 46 and 44 of the first connecting strip-like portion 42 is connected along the fourth predetermined length thereof to the first outer edge 24 of such second elongated flat strip-like portion 22 along the second predetermined length thereof. The second outer edge 26 of such axially opposed outer edges of the second flat strip-like portion 22 being engageable, during operation, in a groove-like portion (not shown) formed adjacent the working surface of such printing plate cylinder. Such groove-like portion extending substantially parallel to a longitudinal axis of such printing plate cylinder.

The final essential element of the securement apparatus 10 is a second elongated connecting strip-like portion 52 having axially opposed outer edges 54 and 56 and axially opposed surfaces 58 and 60. Such second connecting strip-like portion 52 further having a fifth predetermined length and a fifth predetermined width, which is equal to or less than the such fourth predetermined width of such first connecting strip-like portion 42, and a fifth predetermined thickness. The first outer edge 54 of such second connecting strip-like portion 52 being connected to a second outer edge 16 of the first flat strip-like portion 12 along the first predetermined length of the first flat strip-like portion 12 and the fifth predetermined length of such second connecting strip-like portion 52. A second outer edge 56 of such axially opposed outer edges 54 and 56 of the second connecting strip-like portion 52 is connected along such fifth predetermined length thereof to a first outer edge 34 of the third flat strip-like portion 32 along the third predetermined length thereof, thereby forming the specially configured S-shaped printing plate securement apparatus 10.

In the presently preferred embodiment of the invention, each of such first predetermined length of the first flat strip-like portion 12 and the second predetermined length of such second flat strip-like portion 22 and the third predetermined length of such third flat strip-like portion 32 as well as the fourth predetermined length of such first connecting strip-like portion 42 and such fifth predetermined length of such second connecting strip-like portion 52 are all substantially identical.

In this embodiment, it is also preferred that the second predetermined width of such second flat strip-like portion 22 and such third predetermined width of the third flat strip-like portion 32 will be less than half the first flat strip-like portion 12.

Likewise, in the presently preferred embodiment of the invention, the fourth predetermined width of such first connecting strip-like portion 42 will be greater than the fifth predetermined width of such second connecting strip-like portion 52. Furthermore, this fourth predetermined width of such first connecting strip-like portion 42 will be at least sufficient to provide a spacing between such first surface 28 of the axially opposed surfaces 28 and 30 of such second flat strip-like portion 22 and the first surface 18 of the axially opposed surfaces 18 and 20 of the first flat strip-like portion 12 of at least about thirty-thousandths of an inch. In the most preferred embodiment, such fourth predetermined width of the first connecting strip-like portion 42 will provide a spacing between such first surface 28 of the axially opposed surfaces 28 and 30 of such second flat strip-like portion 22 and such first surface 18 of the axially opposed surfaces 18 and 20 of such first flat strip-like portion 12 of between about thirty-thousandths of an inch and about eighty-thousandths of an inch. It should be noted that the spacing between the first surface 38 of the axially opposed surfaces 38 and 40 of the third strip-like portion 3 and such second surface 20 of the axially opposed surfaces 18 and 20 of the first strip-like portion 12 will be less than such spacing between the first surface 28 of the axially opposed surfaces 28 and 30 of such second flat strip-like portion 22 and such first surface 18 of such axially opposed surfaces 18 and 20 of such first flat strip-like portion 12.

Although the present invention is not limited thereto, as will be seen from the discussion hereinafter of FIG. 2. It is preferred, at the present time, that such first flat strip-like portion 12 will be formed as a single piece. This is the case because it is, also, presently preferred that the first strip-like portion 12 and the second strip-like portion 22 and the third strip-like portion 32 as well as the first connecting strip-like portion 42 and the second connecting strip-like portion 52 be formed as an integral single piece unit. The forming of such integral single piece unit is preferably accomplished by an extrusion process. The most preferred extrusion process being a plastic extrusion.

In the most preferred embodiment of the invention, the spacing formed by surface 28 of the second flat strip-like portion 22 and the surface 18 of the first flat strip-like portion 12 will be substantially uniform across both a width dimension thereof and along a length dimension thereof. It is also presently preferred that the spacing formed by surface 38 of the third flat strip-like portion 32 and the surface 20 of the first flat strip-like portion 12 will also be substantially uniform across a width dimension thereof and along a length dimension thereof.

Such first predetermined thickness of the first flat strip-like portion 12 and such second predetermined thickness of the second flat strip-like portion 22 and the third predetermined thickness of such third flat strip-like portion 32 will be substantially identical in the presently preferred embodiment of the invention.

Further, such fourth predetermined thickness of the first connecting strip-like portion 42 will be substantially identical to such fifth predetermined thickness of the second connecting strip-like portion 52 in this embodiment of the invention.

In the most preferred embodiment of the invention, the predetermined thickness of each of the first flat strip-like portion 12 and the second flat strip-like portion 22 and the third flat strip-like portion 32 and the first connecting strip-like portion 42 and the second connecting strip-like portion 52 will all be substantially identical.

It is also preferred that the predetermined length of each of such first flat strip-like portion 12 and the second flat strip-like portion 22 and the third flat strip-like portion 32 and the first connecting strip-like portion 42 and the second connecting strip-like portion 52 will be less than a length of such groove-like portion formed adjacent such working surface of such printing plate cylinder.

Figure 2:
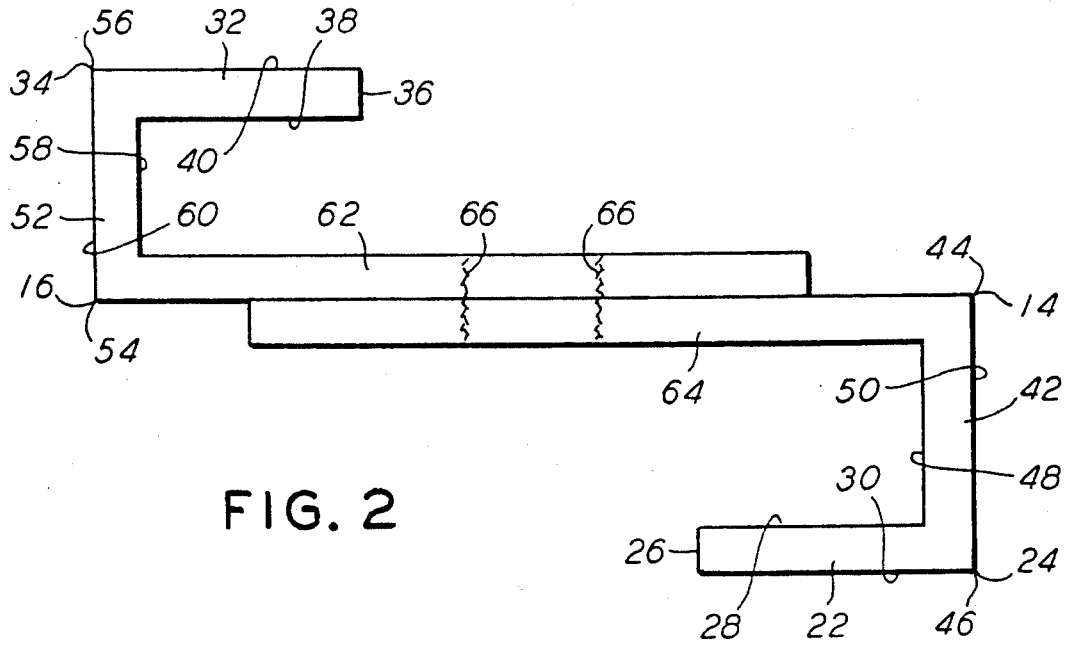
FIG. 2 is a side elevation view of an alternative embodiment of the specially configured securement apparatus illustrated in FIG. 1.

As shown in FIG. 2, the equivalent of the first flat strip-like portion 12 illustrated in FIG. 1 can be formed in two pieces 62 and 64. In this case at least a portion of the elements 62 and 64 must overlap and be secured together by stitching 66 or an adhesive (not shown).

In operation, a bar-like member (not shown) is disposed adjacent one edge of the groove-like portion adjacent the working surface of the printing plate cylinder will be disposed in the spacing formed by surface 28 of the second flat strip-like portion, surface 48 of the first connecting strip-like portion 42 and surface 18 of the first strip-like portion 12. Further, a printing plate (not shown) carried on a sheet-like material (not shown) having a securement apparatus (not shown) attached to a leading edge thereof will be connected to such printing plate cylinder within the spacing formed by the surface 38 of such third flat strip-like portion 32, surface 58 of such second connecting strip-like portion 52 and the surface 20 of such first flat strip-like portion 12.

While a number of presently preferred and alternative embodiments of the specially configured printing plate securement apparatus have been described in considerable detail above, it should be understood that various other modifications and adaptations of the present invention can be made by those persons who are skilled in the printing plate securing art without departing from the spirit and scope of the appended claims.

I claim:

1. A specially configured printing plate securement apparatus for use both in securing at least one printing plate disposed on a upper surface of a printing plate carrier sheet member to at least a predetermined portion of a working surface of at least one printing plate cylinder having a groove-like portion and disposed in at least one print station of a printing arrangement and in achieving a relatively quick alignment of such printing plate in a predetermined position on such working surface of such printing plate cylinder, said specially configured printing plate securement apparatus comprising:

(a) a first elongated and substantially flat strip-like portion having each of axially opposed outer edges and axially opposed surfaces, said first flat strip-like portion further having a first predetermined length and a first predetermined width and a first predetermined thickness;

(b) a second elongated and substantially flat strip-like portion having each of axially opposed outer edges and axially opposed surfaces, said second flat-strip-like portion further having a second predetermined length and a second predetermined width, which is less than said first predetermined width of said first flat strip-like portion, and a second predetermined thickness, a first surface of said axially opposed surfaces of said second flat strip-like portion facing a first surface of said axially opposed surfaces of said first flat strip-like portion;

(c) A third elongated and substantially flat strip-like portion having each of axially opposed outer edges and axially opposed surfaces, said third flat strip-like portion further having a third predetermined length and a third predetermined width, which is less than said first predetermined width of said first flat strip-like portion, and a third predetermined thickness, a first surface of said axially opposed surfaces of said third flat strip-like portion facing a second surface of said axially opposed surfaces of said first flat strip-like portion;

(d) a first elongated connecting strip-like portion having axially opposed outer edges and axially opposed surfaces, said first connecting strip-like portion further having a fourth predetermined length and a fourth predetermined width and a fourth predetermined thickness; a first outer edge of said axially opposed outer edge of said first connecting strip-like portion being connected to a first outer edge of said axially opposed outer edges of said first flat strip-like portion along said first predetermined length of said first flat strip-like portion and said fourth predetermined length of said first connecting strip-like portion and a second outer edge of said axially opposed outer edges of said first connecting strip-like portion being connected to a first outer edge of said axially opposed outer edges of said second flat strip-like portion along said second predetermined length of said second flat strip-like portion and said fourth predetermined length of said first connecting strip-like portion, a second outer edge of said axially opposed outer edges of said second flat strip-like portion being engageable in such groove-like portion formed adjacent such working surface of such printing plate cylinder and substantially parallel to a longitudinal axis thereof; and (e) a second elongated connecting strip-like portion having axially opposed outer edges and axially opposed surfaces, said second connecting strip-like portion further having a fifth predetermined length and a fifth predetermined width, which is equal to or less than said fourth predetermined width of said first connecting strip-like portion, and a fifth predetermined thickness, a first outer edge of said axially opposed outer edges of said second connecting strip-like portion being connected to a second outer edge of said axially opposed outer edges of said first flat strip-like portion along said first predetermined length of said first flat strip-like portion and said fifth predetermined length of said second connecting strip-like portion and a second outer edge of said axially opposed outer edges of said second connecting strip-like portion being connected along said fifth predetermined length thereof to a first outer edge of said axially opposed outer edges of said third flat strip-like portion along said third predetermined length thereof, thereby forming a specially configured S-shaped printing plate securement apparatus.

2. A specially configured printing plate securement apparatus, according to claim 1, wherein each of said first predetermined length of said first flat strip-like portion and said second predetermined length of said second flat strip-like portion and said third predetermined length of said third flat strip-like portion and said fourth predetermined length of said first connecting strip-like portion and said fifth predetermined length of said second connecting strip-like portion are substantially identical.

3. A specially configured printing plate securement apparatus, according to claim 2, wherein said second predetermined width of said second flat strip-like portion and said third predetermined width of said third flat strip-like portion are less than one-half said first predetermined width of said first flat strip-like portion.

4. A specially configured printing plate securement apparatus, according to claim wherein said fourth predetermined width of said first connecting strip-like portion is greater than said fifth predetermined width of said second connecting strip-like portion.

5. A specially configured printing plate securement apparatus, according to claim 4, wherein said fourth predetermined width of said first connecting strip-like portion is at least sufficient to provide a spacing between said first surface of said axially opposed surfaces of said second flat strip-like portion and said first surface of said axially opposed surfaces of said first flat strip-like portion of at least about thirty-thousandths of an inch.

6. A specially configured printing plate securement apparatus, according to claim 5, wherein said fourth predetermined width of said first connecting strip-like portion provides a spacing between said first surface of said axially opposed surfaces of said second flat strip-like portion and said first surface of said axially opposed surfaces of said first flat strip-like portion of between about thirty-thousandths of an inch and about eighty-thousandths of an inch.

7. A specially configured printing plate securement apparatus, according to claim 6, wherein a spacing between said first surface of said axially opposed surfaces of said third flat strip-like portion and said second surface of said axially opposed surfaces of said first flat strip-like portion is less that said spacing between said first of said axially opposed surfaces of said second flat strip-like portion and said first surface of said axially opposed surfaces of said first flat strip-like portion.

8. A specially configured printing plate securement apparatus, according to claim 3, wherein said fourth predetermined width of said first connecting strip-like portion is greater than said fifth predetermined width of said second connecting strip-like portion and provides a spacing between said first surface of said axially opposed surfaces of said second flat strip-like portion and said first surface of said axially opposed surfaces of said first flat strip-like portion of between about thirty-thousandths of an inch and about eighty-thousandths of an inch.

9. A specially configured printing plate securement apparatus, according to claim wherein said first flat strip-like portion is formed as an integral single piece unit.

10. A specially configured printing plate securement apparatus, according to claim 9, wherein said first flat strip-like portion and said second flat strip-like portion and said third flat strip-like portion and said first connecting strip-like portion and said second connecting strip-like portion are formed as an integral single piece unit.

11. A specially configured printing plate securement apparatus, according to claim 10, wherein said integral single piece unit is formed as an extrusion.

12. A specially configured printing plate securement apparatus, according to claim 11, wherein said extrusion is plastic.

13. A specially configured printing plate securement apparatus, according to claim 3, wherein said first flat strip-like portion and said second flat strip-like portion and said third flat strip-like portion and said first connecting strip-like portion and said second connecting strip-like portion are formed as an integral single piece extrusion.

14. A specially configured printing plate securement apparatus, according to claim 7, wherein said first flat strip-like portion and said second flat strip-like portion and said third flat strip-like portion and said first connecting strip-like portion and said second connecting strip-like portion are formed as an integral single piece plastic extrusion.

15. A specially configured printing plate securement apparatus, according to claim 14, wherein said spacing between said first surface of said axially opposed surfaces of said second flat strip-like portion and said first surface of said axially opposed surfaces of said first flat strip-like portion is substantially uniform across both a width dimension thereof and across a length dimension thereof.

16. A specially configured printing plate securement apparatus, according to claim 15, wherein said spacing between said first surface of said axially opposed surfaces of said third flat strip-like portion and said second surface of said axially opposed surfaces of said first flat strip-like portion is substantially uniform across both a width dimension thereof and a length dimension thereof.

17. A specially configured printing plate securement apparatus, according to claim 15, wherein said first predetermined thickness of said first flat strip-like portion and said second predetermined thickness of said second flat strip-like portion and said third predetermined thickness of said third flat strip-like portion are substantially identical.

18. A specially configured printing plate securement apparatus, according to claim 17, wherein said fourth predetermined thickness of said first connecting strip-like portion is substantially identical to said fifth predetermined thickness of said second connecting strip-like portion.

19. A specially configured printing plate securement apparatus, according to claim 10, wherein said first predetermined thickness of said first flat strip-like portion and said second predetermined thickness of said second flat strip-like portion and said third predetermined thickness of said third flat strip-like portion and said fourth predetermined thickness of said first connecting strip-like portion and said fifth predetermined thickness of said second connecting strip-like portion are substantially identical.

20. A specially configured printing plate securement apparatus, according to claim wherein said first predetermined length of said first flat strip-like portion and said second predetermined length of said second flat strip-like portion and said third predetermined length of said third flat strip-like portion and said fourth predetermined length of said first connecting strip-like portion and said fifth predetermined length of said second connecting strip-like portion are less than a length of such groove-like portion formed adjacent such working surface of such printing plate cylinder.

* * * * *

UNITED STATES PATENT AND TRADEMARK OFFICE

CERTIFICATE OF CORRECTION

PATENT NO. : 5,136,947

DATED : August 11, 1992

INVENTOR(S) : Ivan N. Philpot

It is certified that error appears in the above-identified patent and that said Letters Patent is hereby corrected as shown below:

Column 5, line 51, delete "3" and insert --32--.

Column 8, line 38, after claim, insert --1,--.

Column 9, line 13, after claim, insert --1,--.

Column 10, line 37, after claim, insert --1,--.

Signed and Sealed this

Thirty-first Day of August, 1993

Bruce Lehman

*Attest:*

BRUCE LEHMAN

*Attesting Officer*

*Commissioner of Patents and Trademarks*